United States Patent [19]

Kuo

[11] Patent Number: 5,039,087

[45] Date of Patent: Aug. 13, 1991

[54] POWER STAIRCLIMBER

[76] Inventor: Hai-Pin Kuo, Che-Lu-Chien No. 30, Pao-An-Tsun, Jen-Ten Hsiang, Tainan City, Taiwan

[21] Appl. No.: 522,105

[22] Filed: May 11, 1990

[51] Int. Cl.[5] ..... A63B 23/04

[52] U.S. Cl. ..... 272/70; 128/25 R

[58] Field of Search ..... 272/69, 70, 71, 73, 272/96, 97, 130, 112, 129; 128/25 R

[56] References Cited

U.S. PATENT DOCUMENTS

| | | | |
|---|---|---|---|
| 2,042,764 | 6/1932 | Birch | 272/69 |
| 4,830,362 | 5/1989 | Ball | 272/70 |
| 4,848,737 | 7/1989 | Ehrenfield | 272/70 |

*Primary Examiner*—Stephen R. Crow

*Attorney, Agent, or Firm*—Morton J. Rosenberg; David I. Klein

[57] ABSTRACT

This invention relates to a power stairclimber and in particular to one including a base on which there are mounted a pair of pedals and a handlebar, a gear pivoted on the base, two driving rods respectively mounted on two sides of the gear and arranged at opposite directions, two cranks rotatably connected at one end with the lugs of the base and at the other end with the driving rods and a worm gear meshed with the gear and having on the top a pulley which is in turn connected with a motor via a belt.

1 Claim, 5 Drawing Sheets

POWER STAIRCLIMBER

BACKGROUND OF THE INVENTION

This invention relates to a power stairclimber.

While the type and extent of the exercise individuals practice often depends on a physician's recommendations, it is recognized that exercise should not only be regular but also sufficiently strenuous to cause the heart beat to be accelerated for a reasonable but substantial interval.

For many, exercise outdoors is preferred with jogging popular while others enjoy brisk walks. For others, however, weather conditions and the character of the neighborhood make necessary to use a indoor bicycle or a treadmill exerciser.

Such devices, however, are monotonous to use as a consequence of which, interest in an exercise program is often lost so that what is needed is a way to make the use of such devices a pleasurable interval with the exercise automatically taking place.

It is, therefore, an object of the present invention to provide an exerciser which may obviate and mitigate the above-mentioned drawbacks.

SUMMARY OF THE INVENTION

This invention relates to a power stairclimber for providing exercise for the legs.

It is the primary object of the present invention to provide a power stairclimber which may effectively exercise the legs of an user.

It is another object of the present invention to provide a power stairclimber which is safe in use.

It is still another object of the present invention to provide a power stairclimber which is sturdy in construction.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
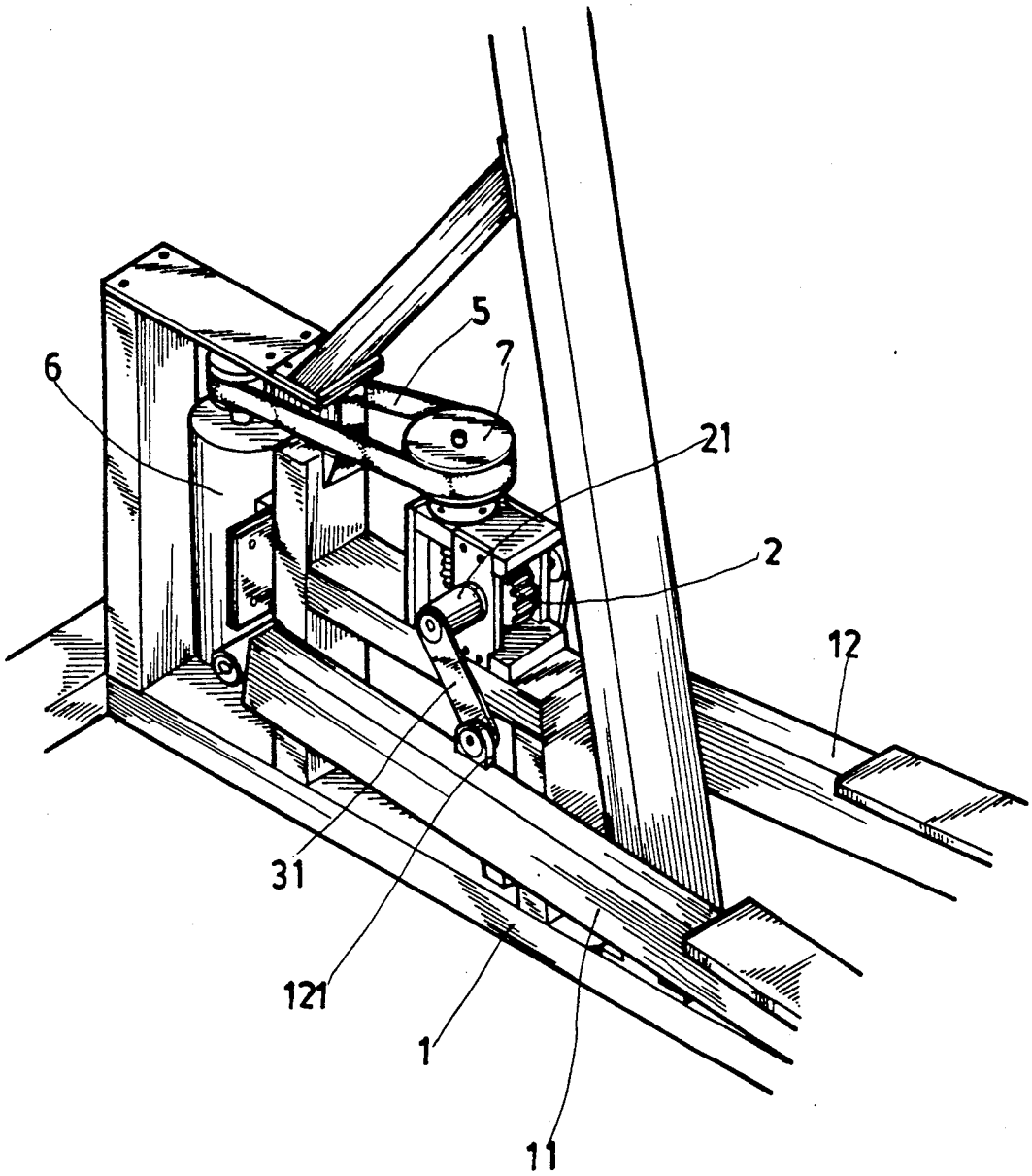
FIG. 1 is a perspective view showing the main structure of a power stairclimber according to the present invention.
Figure 2:
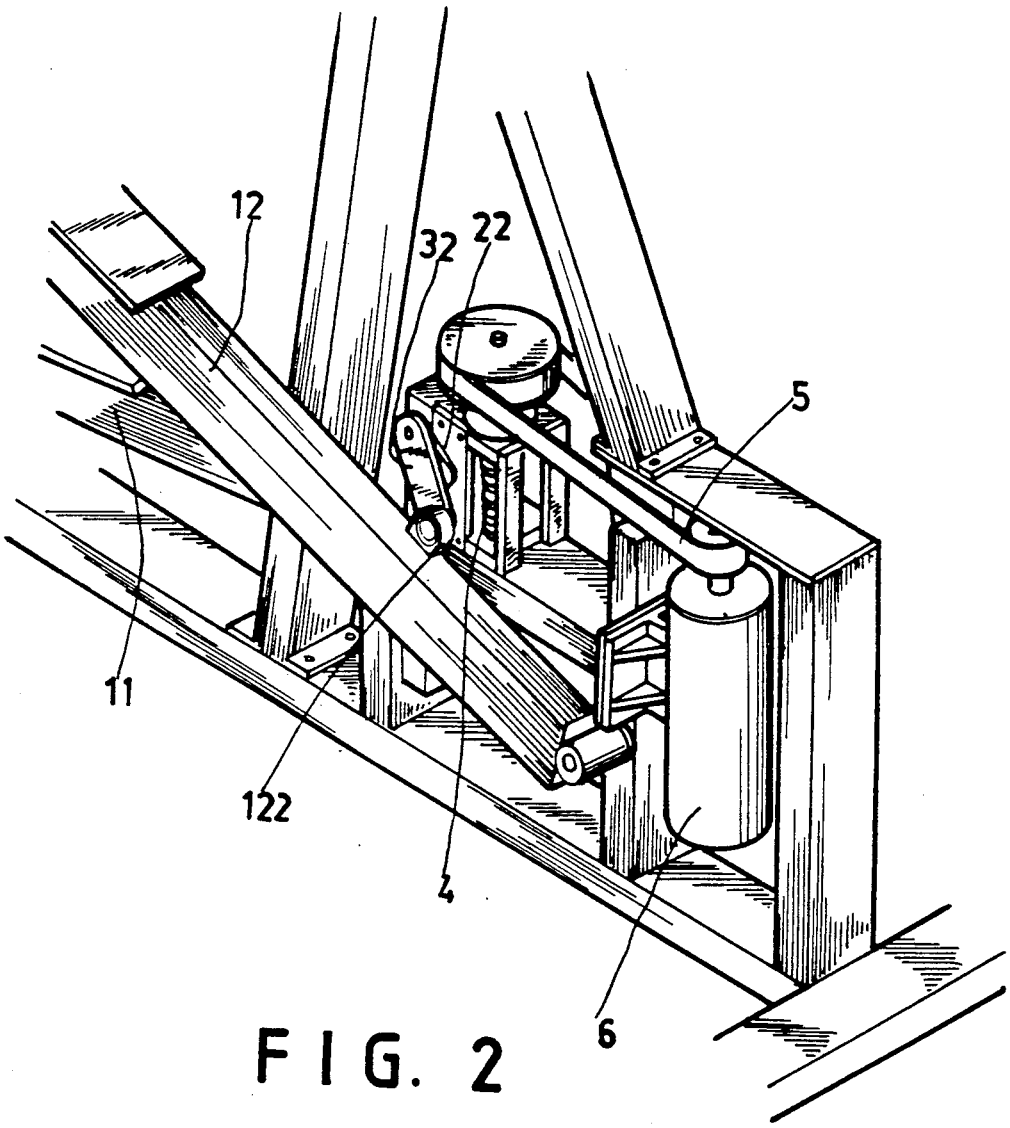
FIG. 2 is another perspective view showing the main structure of the power stairclimber.
Figure 4:
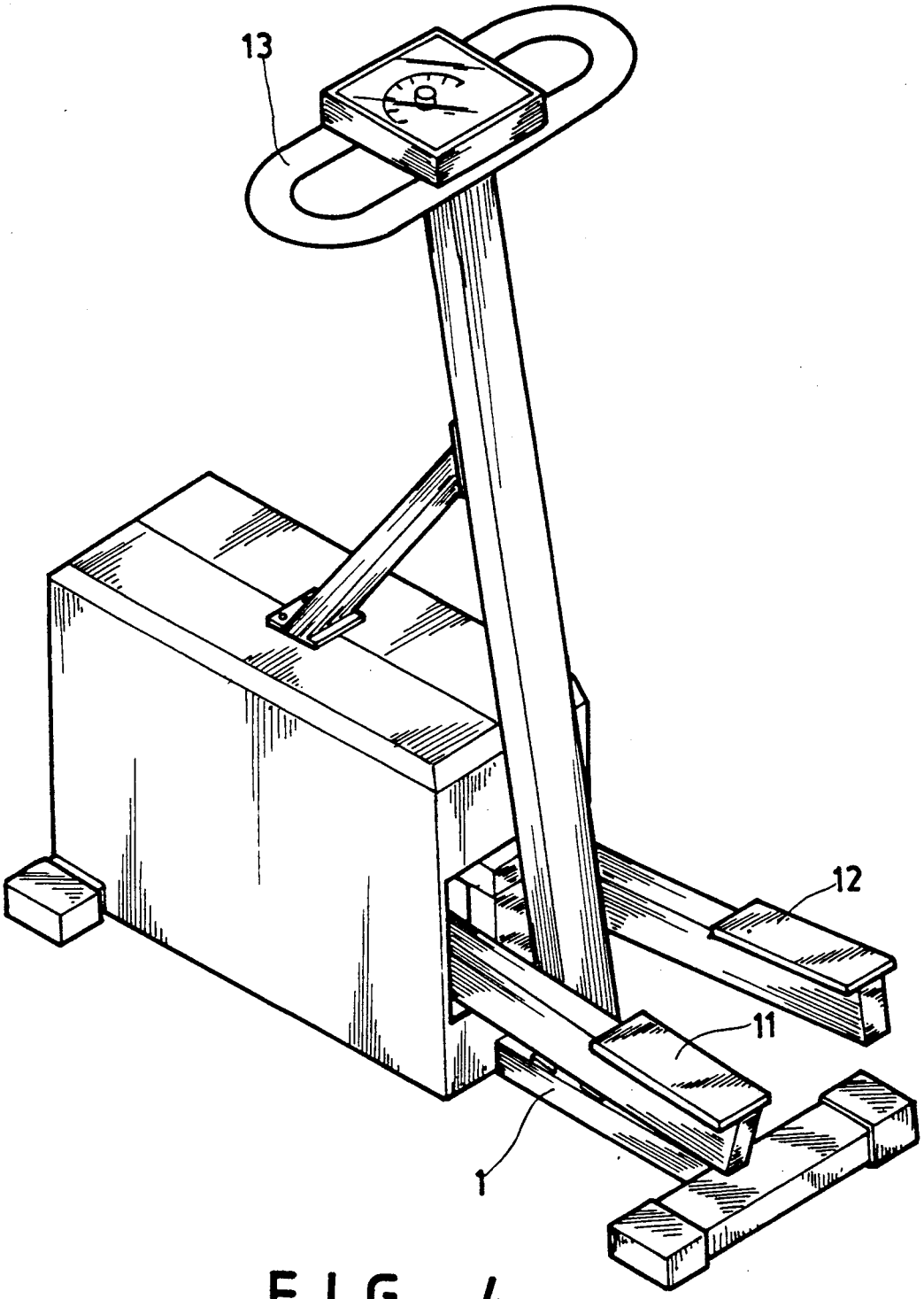
FIG. 4 is a perspective view of the power stairclimber.
Figure 5:
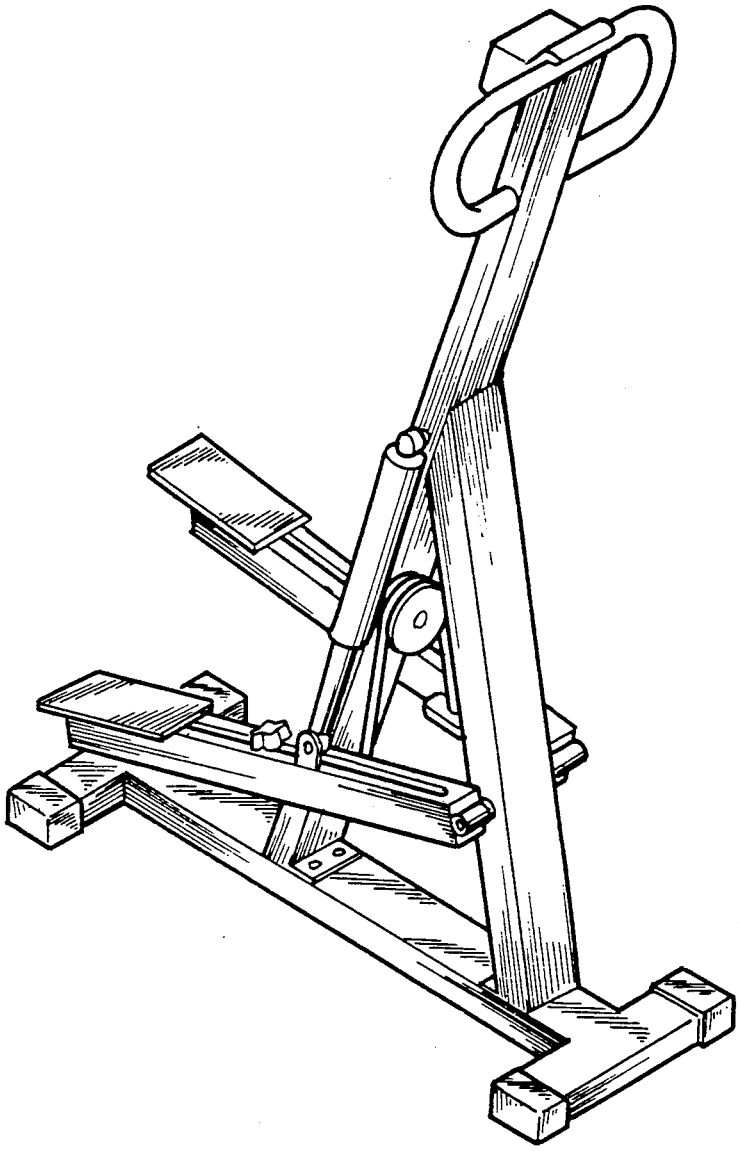
PRIOR ART FIG. 5
FIG. 5 is a perspective view of a prior art stairclimber.

With reference to the drawings and in particular to FIG. 4 thereof, the power stairclimber according to the present invention comprises a base 1 on which there are mounted a left pedal 11, a right pedal 12 and a handlebar 13. Looking now at FIGS. 1 and 2, the base 1 is provided with a gear 2 which has two driving rods 21 and 22 respectively mounted at one side thereof and arranged at opposite directions. The two driving rods 21 and 22 are fixedly connected with the gear 2 so that they can rotate together. The pedals 11 and 12 are movably mounted on the base 1 at the rear end and have lugs 121 and 122 on the top for connecting an end of the cranks 31 and 32. The other ends of the cranks 31 and 32 are rotatably connected with the driving rods 11 and 12 respectively. The gear 2 is also meshed with a worm gear 4 on the top of which there is mounted a pulley 7 which is in turn connected with a motor 6 via a belt 5.

Figure 3:
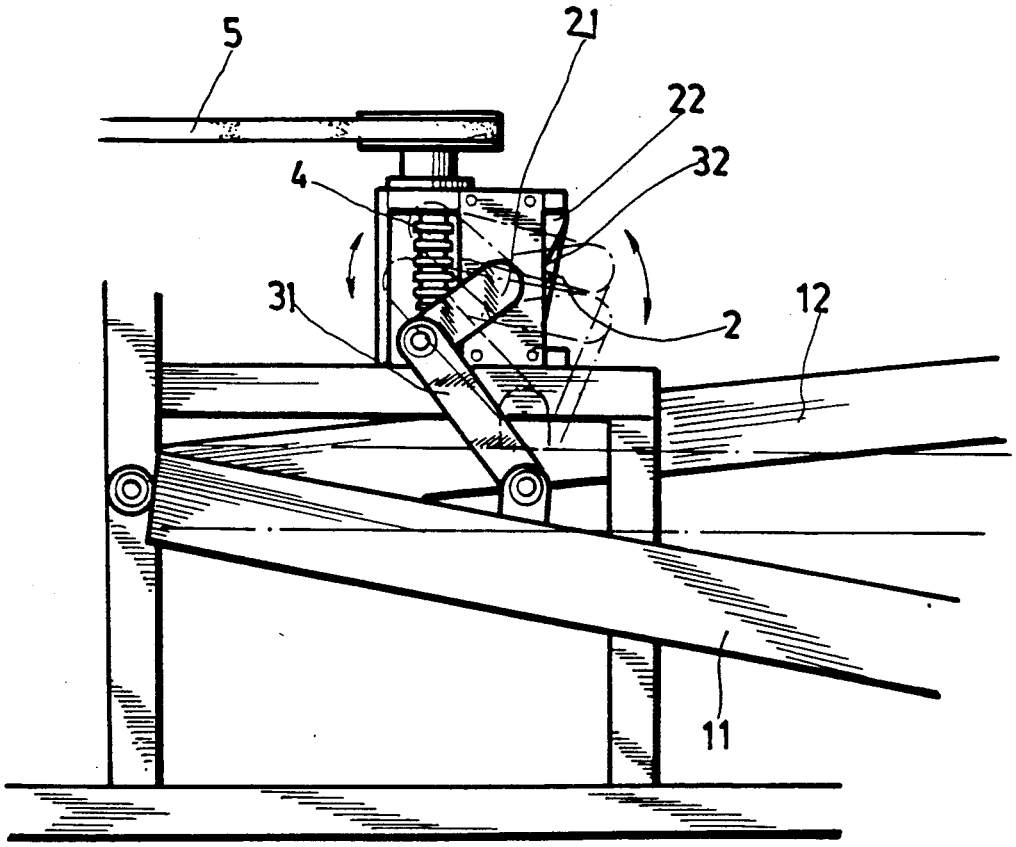
FIG. 3 shows the principle of the power stairclimber.

Referring to FIG. 3, when the motor 6 starts rotating, the worm gear 4 will rotate in unison therewith by means of the belt and the pulley 7. Then the gear 2 meshed with the worm gear 4 will be rotated. Since the driving rods 21 and 22 are disposed at opposite directions, the driving rods 21 and 22 will turn the cranks 31 and 32 thereby moving the pedal 11 up and the other pedal 12 down and vice versa. As a consequence, the user standing the pedals will do a stairclimbing exercise when the motor is turned on.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A power stairclimber comprising:

a base on which there are mounted a left pedal, right pedal and a handlebar, said pedals being movably mounted on said base at the rear end of said base and said pedals having a lug on their respective top;

a gear rotatably mounted on said base;

two driving rods respectively mounted on two sides of said gear and oriented in opposite coaxial opposite directions;

two cranks rotatably connected at one end with the lugs of said base and at the other end with said driving rods; and a worm gear meshed with said gear and having at one end a pulley which is in turn connected with a motor via a belt; whereby when said motor rotates, said worm gear rotates and drives said rods thereby reciprocating said pedals.

* * * * *